US008678120B2

(12) United States Patent
Shimomura et al.

(10) Patent No.: US 8,678,120 B2
(45) Date of Patent: Mar. 25, 2014

(54) METHOD AND APPARATUS FOR MOUNTING DEVICE IN CONSTRUCTION MACHINE

(75) Inventors: Keisuke Shimomura, Hiroshima (JP); Takayuki Okunishi, Hiroshima (JP); Shinji Katsuhara, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 13 days.

(21) Appl. No.: 13/547,558

(22) Filed: Jul. 12, 2012

(65) Prior Publication Data

US 2013/0026795 A1 Jan. 31, 2013

(30) Foreign Application Priority Data

Jul. 27, 2011 (JP) ..... 2011-164285

(51) Int. Cl.
*B62D 33/00* (2006.01)
*B62D 21/00* (2006.01)
*F16F 1/36* (2006.01)

(52) U.S. Cl.
USPC ..... 180/89.1; 37/466; 172/776; 180/311; 248/638; 267/292; 280/781; 296/203.01

(58) Field of Classification Search
USPC ..... 29/428; 37/466; 172/776; 180/68.4, 180/89.1, 89.12, 311, 312; 267/130, 140, 267/140.11, 152, 153, 292; 280/781, 788; 296/190.04, 190.07, 203.01, 204; 403/365, 372; 248/560, 637, 638
See application file for complete search history.

(56) References Cited

U.S. PATENT DOCUMENTS

| | | | | | |
|---|---|---|---|---|---|
| 1,833,424 | A | * | 11/1931 | Jansson | 180/68.4 |
| 3,948,340 | A | * | 4/1976 | Breitschwerdt | 180/89.1 |
| 4,519,467 | A | * | 5/1985 | Saunders | 180/68.4 |
| 4,538,697 | A | * | 9/1985 | Muroi et al. | 180/68.4 |
| 4,982,974 | A | * | 1/1991 | Guidry | 280/164.2 |
| 5,335,893 | A | * | 8/1994 | Opp | 248/635 |
| 5,409,283 | A | * | 4/1995 | Ban | 296/35.1 |
| 5,544,714 | A | * | 8/1996 | May et al. | 180/68.4 |
| 6,000,703 | A | * | 12/1999 | Schubert et al. | 280/5.518 |
| 6,364,296 | B1 | * | 4/2002 | Cummings et al. | 267/141.4 |

(Continued)

FOREIGN PATENT DOCUMENTS

| | | | | | |
|---|---|---|---|---|---|
| JP | 57060911 | A | * | 4/1982 | B60K 11/04 |
| JP | 58161616 | A | * | 9/1983 | B60K 5/12 |

(Continued)

*Primary Examiner* — Toa To
*Assistant Examiner* — Laura Freedman
(74) *Attorney, Agent, or Firm* — Oblon, Spivak, McClelland, Maier & Neustadt, L.L.P.

(57) ABSTRACT

Provided is a method for mounting a device on a frame in a construction machine. The method includes forming plate holes in a beam member at respective mount-member-provision positions on the beam member; mounting a plate supporter on a back surface of the beam member at each of the mount-member-provision positions so as to border the plate hole at a lower side thereof; installing the beam member on the frame; putting the mount plate into the plate hole from above so as to make the mount plate be supported by the plate supporter and fixing the plate supporter in the plate hole after adjusting the position of the mount plate horizontally and vertically within the plate hole; and mounting the mount members to the mount plates fixed in the plate holes respectively and mounting the device on the beam member via the mount members.

5 Claims, 4 Drawing Sheets

(56) References Cited

U.S. PATENT DOCUMENTS

| | | | | |
|---|---|---|---|---|
| 7,036,251 | B2 * | 5/2006 | Kojima et al. | 37/466 |
| 7,070,157 | B2 * | 7/2006 | Huprikar et al. | 248/636 |
| 7,413,092 | B2 * | 8/2008 | Hanamoto | 212/181 |
| 7,416,174 | B2 * | 8/2008 | Dickson et al. | 267/141.1 |
| 7,419,186 | B2 * | 9/2008 | Murakami et al. | 280/781 |
| 7,828,371 | B2 * | 11/2010 | Murakami | 296/190.03 |
| 7,854,471 | B2 * | 12/2010 | Fujii et al. | 296/190.03 |
| 7,950,725 | B2 * | 5/2011 | Murakami et al. | 296/190.03 |
| 8,128,155 | B2 * | 3/2012 | Ansorge | 296/190.03 |
| 8,240,745 | B2 * | 8/2012 | Yamamoto et al. | 296/190.03 |
| 8,381,865 | B2 * | 2/2013 | Okada | 180/309 |
| 8,500,191 | B1 * | 8/2013 | Baccouche et al. | 296/187.08 |
| 8,517,457 | B2 * | 8/2013 | Yamamoto et al. | 296/190.07 |
| 2011/0162908 | A1 * | 7/2011 | Masuda et al. | 181/211 |
| 2012/0112495 | A1 * | 5/2012 | Honda et al. | 296/204 |

FOREIGN PATENT DOCUMENTS

| | | | | | |
|---|---|---|---|---|---|
| JP | 04357345 | A | * | 12/1992 | F16F 15/06 |
| JP | 05098666 | A | * | 4/1993 | E02F 9/16 |
| JP | 05255950 | A | * | 10/1993 | E02F 9/16 |
| JP | 05255951 | A | * | 10/1993 | E02F 9/16 |
| JP | 06116981 | A | * | 4/1994 | E02F 9/18 |
| JP | 06156318 | A | * | 6/1994 | B62D 25/08 |
| JP | 2004293246 | A | * | 10/2004 | E02F 9/08 |
| JP | 2010076659 | A | * | 4/2010 | |
| JP | 2011-20641 | | | 2/2011 | |

* cited by examiner

METHOD AND APPARATUS FOR MOUNTING DEVICE IN CONSTRUCTION MACHINE

BACKGROUND OF THE INVENTION

1. Field of the Invention

The present invention relates to a method and apparatus for mounting, on a frame in a construction machine such as a hybrid excavator, various devices, for example, a hybrid device such as a capacitor or an inverter, or other device.

2. Description of the Background Art

The background art of the present invention is described by an example of an excavator shown in FIG. 5. As shown in FIG. 5, the excavator is provided with a crawler-type lower propelling body 1, and an upper slewing body 2 loaded on the lower propelling body 1 to be sleweable about an axis vertical to the ground. The upper slewing body 2 has an upper frame 3 as a base member, on which various equipments and devices such as a cabin 4 are loaded. A working attachment 5 is mounted on a front portion of the upper frame 3. In the specification, the position of the cabin 4 is defined as a left-side front portion, and front and rear directions (longitudinal direction) and left and right directions (lateral direction) are defined with respect to the position of the cabin 4.

FIG. 6 schematically shows an arrangement of the upper frame 3 and a structure for mounting devices on the upper frame 3.

The upper frame 3 includes a pair of left and right vertical plates 6, 7 also serving as a reinforcing member and an attachment mounting member. The upper frame 3 has a rear portion including respective rear portions of the vertical plates 6, 7, and unillustrated power system devices including an engine are loaded on the rear portion. There are provided a left-side deck (cabin deck) 8 and a right-side deck 9 on the outer side (left side) of the left vertical plate 6 and on the right side of the right vertical plate 7, respectively. The cabin 4 shown in FIG. 5 is loaded on the left-side deck 8, while a device 10, specifically, a hydraulic system device and a hybrid device such as a capacitor or an inverter, are disposed on the right-side deck 9.

The device 10 is installed on a front portion of the right-side deck 9 via a plurality of mount members 11, in general, two mount members 11 on each of a front portion and a rear portion. Specifically, there are horizontally mounted and longitudinally spaced a pair of a front beam member 12 and a rear beam member 12 on the right-side deck 9, and the mount members 11 are mounted on the beam members 12, 12. In detail, each of the beam members 12 is provided with mount holes 13 at respective positions where the mount members 11 are mounted, and the mount member 11 (generally made of a rubber material) corresponding to each of the mount holes 13 is put thereinto. The device 10 is loaded on the mount members 11 and fastened to the beam members 12, 12 by bolts 14 and nuts 15 (see Japanese Unexamined Patent Publication No. 2011-20641).

This conventional structure has a difficulty in mounting the device 10 with high accuracy. Specifically, for assembling the upper frame 3, the beam members 12, 12 are fixed to the right vertical plate 7 or the like by welding, thus involving a welding heat which is likely to provide distortion or warp to the mounting surface of each of the mount members 11. This can change the horizontal/vertical position or the levelness of each of the mount members 11. To solve the problem, the conventional structure including the well-known art disclosed in Japanese Unexamined Patent Publication No. 2011-20641 has no adjusting means; the device 10 is therefore mounted on the mount members 11 without cancelling deviation, which lowers the accuracy of mounting the device 10. The above problem may be serious in mounting a hybrid device which is required to have a particularly high precision.

SUMMARY OF THE INVENTION

An object of the invention is to provide a method and apparatus for mounting a device in a construction machine by use of a beam member and a mount member while allowing the position or the levelness of the mount member to be adjusted to thus enhance the mounting precision of the device.

Specifically, the invention provides a method for mounting the device on a frame in a construction machine via a beam member and a plurality of mount members, the method including: forming a plurality of plate holes in the beam member at respective spaced mount-member-provision positions; attaching a plate supporter to a back surface of the beam member at each of the mount-member-provision positions so that the plate supporter borders the plate hole on a lower side of the beam member; installing the beam member on the frame; putting a mount plate into each of the plate holes from above so as to make the support member support the mount plate on a lower side of the mount plate and fixing the mount plate after adjusting a position of the mount plate horizontally and vertically within the plate hole; and mounting each of the mount members to the mount plate fixed in the plate hole corresponding to the mount member and mounting the device on the beam member via the mount members.

Besides, the invention provides an apparatus for mounting a device in a construction machine having a frame, the apparatus including: a beam member which is installed on the frame and provided with a plurality of plate holes at respective mount-member-provision positions; a plurality of plate supporters which are attached to a back surface side of the beam member so as to border the respective plate holes on a lower side of the beam member; a plurality of mount plates which are put into the respective plate holes so as to be supported by the respective plate supporters on a lower side of the mount plate and fixed in the plate hole after a horizontal and vertical adjustment of a position of the mount plate; and a plurality of mount members to be mounted to the respective mount plates so as to allow the device to be mounted on the mount plates via the mount members.

These and other objects, features and advantages of the present invention will become more apparent upon reading the following detailed description along with the accompanying drawings.

DESCRIPTION OF THE PREFERRED EMBODIMENTS

Figure 3:
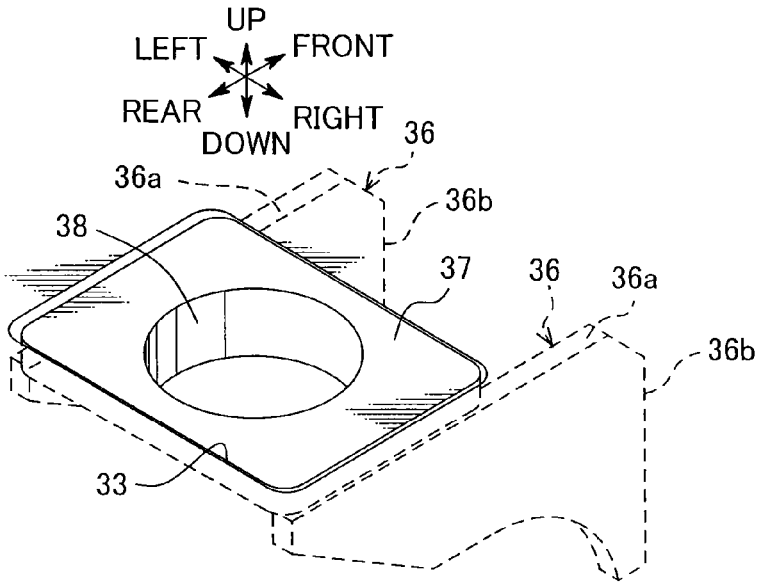
FIG. 3 is a perspective view showing a state that the mount plate is mounted on the plate supporter.
Figure 4:
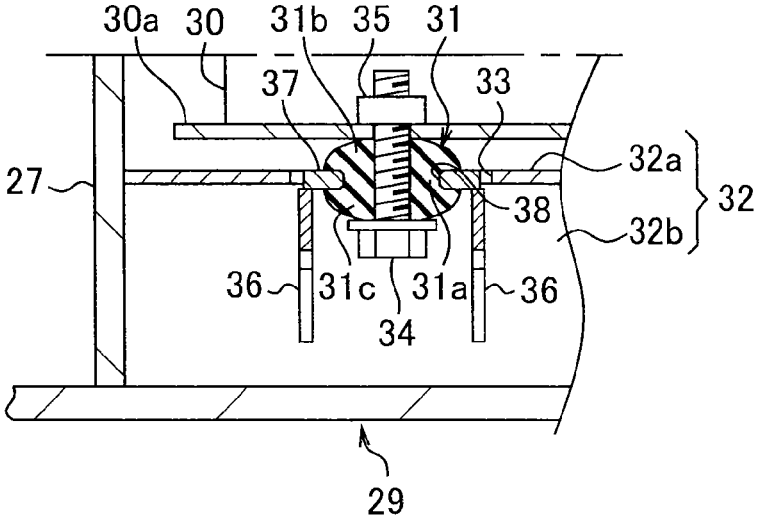
FIG. 4 is a cross-sectional view taken along the line IV-IV in FIG. 2, showing a state that the mount plate is mounted.
Figure 5:
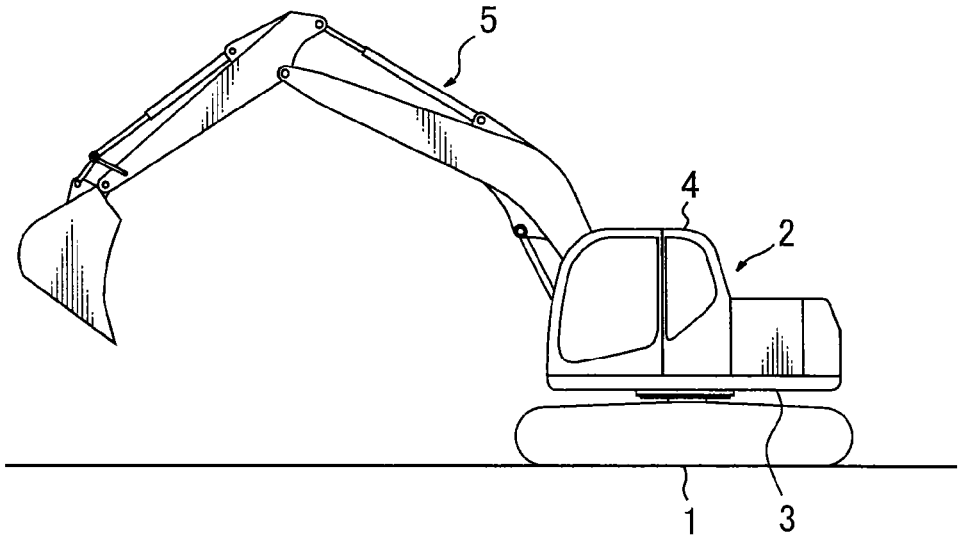
PRIOR ART FIG.5
FIG. 5 is a schematic side view of an excavator as an example to which the invention is applied.
Figure 6:
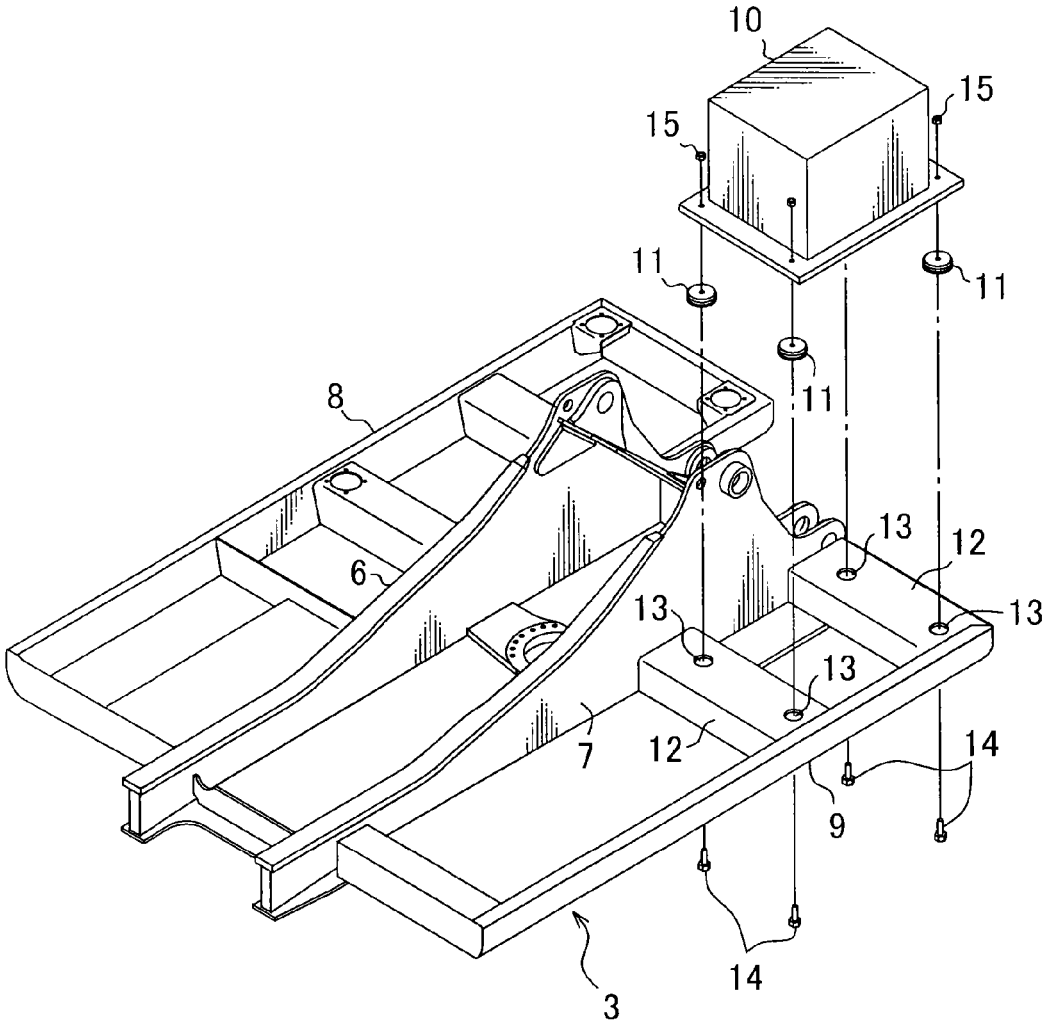
PRIOR ART FIG.6
FIG. 6 is a schematic perspective view showing a conventional device mounting apparatus, and an upper frame in an excavator, on which a device is mounted by the conventional device mounting apparatus.

An embodiment of the invention is described referring to FIGS. 1 through 4. The embodiment is an example where the invention is applied to an excavator substantially the same as the excavator shown in FIG. 5. Specifically, the excavator according to the embodiment is substantially equal to the excavator shown in FIG. 5 except for a point that the excavator according to the embodiment is provided with an upper frame 23, a device 30 and various members provided in association with the upper frame 23 and the device 30, in place of the upper frame 3, the device 10 and the various members provided in association with the upper frame 3 and the device 10 as shown in FIG. 5 and FIG. 6.

Similarly to the upper frame 3, the upper frame 23 includes a pair of left and right vertical plates 26, 27 also serving as a reinforcing member and an attachment mounting member, and unillustrated power system devices including an engine are loaded on a rear portion of the upper frame 23 including the vertical plates 26, 27. The upper frame 23 has a left-side deck (cabin deck) 28 located on the outer side (left side) of the left vertical plate 26 and a right-side deck 29 located on the outer side (right side) of the right vertical plate 27. The cabin 4 shown in FIG. 5 is loaded on the left-side deck 28, while the device 30 is installed on the right-side deck 29. The device 30 is e.g. a hydraulic system device. In the case of a hybrid excavator, the device 30 can include a hybrid device such as a capacitor or an inverter.

The device 30 according to the embodiment is mounted on the upper frame 23 by a device mounting apparatus of the invention, which includes a pair of front and rear beam members 32 and 32, a plurality of plate supporters 36, a plurality of mount plates 37, and a plurality of mount members 31.

The beam members 32 are horizontally installed on the right-side deck 29 of the upper frame 3 while longitudinally spaced. The device 30 is mounted on the beam members 32, 32 by bolts 34 and nuts 35 via the mount members 31. The mount members 31 are generally provided at respective four positions including two positions in the front beam member 32 and two positions in the rear beam member 32, but the position of each of the mount members according to the invention is not specifically limited. In the embodiment, there are determined a plurality of mount-member-provision positions at respective positions near lateral ends of each of the beam members 32.

Figure 1:
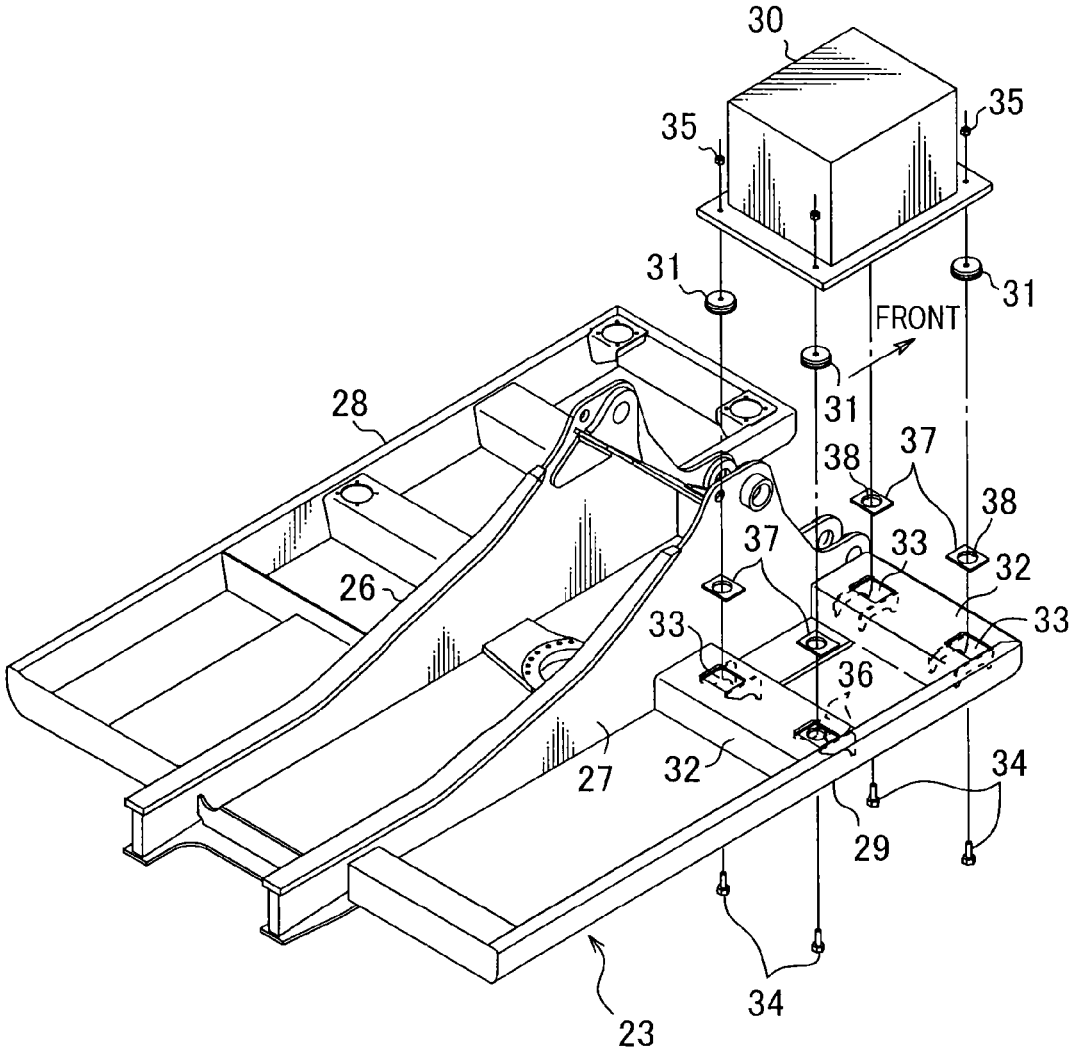
FIG. 1 is a perspective view showing a device mounting apparatus embodying the invention, and an upper frame in an excavator, on which a device is mounted by the device mounting apparatus.
Figure 2:
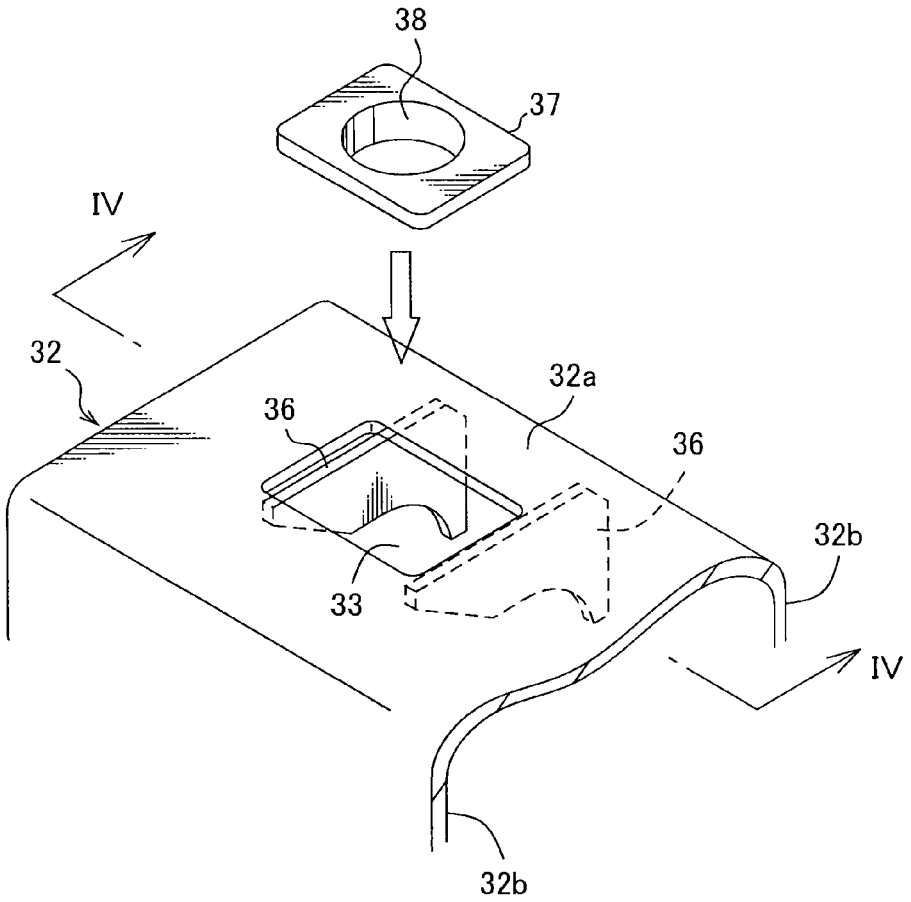
FIG. 2 is an enlarged perspective view showing a state before a mount plate is mounted on a plate supporter of the device mounting apparatus shown in FIG. 1.

As shown in FIG. 2, each of the beam members 32 has a horizontal wall 32*a* and a pair of vertical walls 32*b* extending downward from respective front and rear ends of the horizontal wall 32*a*, and the horizontal wall 32*a* is provided with plate holes 33 at respective positions corresponding to the mount-member-provision positions. The invention is not especially limited to the specific shape of each of the plate holes 33. The plate hole 33 according to the embodiments has a rectangular shape, but the plate hole according to the invention may be a circular shape, an elliptical shape or other shapes.

As shown in FIG. 2 and FIG. 3, each of the plate supporters 36 is attached to the back surface side of the horizontal wall 32*a* of the corresponding beam member 32 so as to border each of the plate holes 33 on a lower side of the plate hole 32. In this embodiment, each of the plate supporters 36 is welded to the beam member 32 across the horizontal wall 32*a* and one of the vertical walls 32*b* continuing thereto. In detail, each of the plate supporters 36 according to the embodiment is shaped as a vertically extending plate, having an upper end surface 36*a* longitudinally extending along the back surface of the horizontal wall 32*a* and a lateral end surface 36*b* vertically extending along the back surface of the vertical wall 32*b*. Each of the plate supporters 36 is attached to the back surface side of the beam member 32 so as to form a rib of the beam member 32, by welding the upper end surface 36*a* and the lateral end surface 36*b* to the horizontal wall 32*a* and the front-side vertical wall 32*b* of the beam member 32 respectively in such a vertical posture that the upper end surface 36*a* traverses both lateral ends, that is, both ends in a first direction, of the plate hole 33 in a longitudinal direction, that is, in a second direction orthogonal to the first direction. However, the invention is not limited to the illustrated plate supporter 36. For instance, according to the invention, one of end surfaces corresponding to the above end surfaces 36*a* and 36*b* may be welded to the beam member, or the plate supporter may be attached on the beam member so as to laterally traverse both longitudinal ends of the plate hole. Alternatively, the plate supporter may be horizontally attached to a back surface of a horizontal wall corresponding to the horizontal wall 32*a* so as to close at least a part of a peripheral edge of the plate hole.

Each of the mount plates 37 is put into the corresponding plate hole 33. Specifically, each of the mount plates 37 according to this embodiment is shaped as a rectangular shape with four sides each having a smaller size than that of the corresponding plate hole 33, and is put into the plate hole 33 so as to be supported by the plate supporters 36, 36 on a lower side of the beam member 32 at lateral ends of the plate hole 33. Each of the mount plates 37 has a mounting hole 38 at a central portion thereof. The mounting hole 38 has a shape of allowing the mount member 31 to be mounted therein. The mounting hole 38 according to this embodiment has a circular shape.

Each of the mount members 31 according to this embodiment is made of an elastic material such as rubber and formed in a tubular shape, which allows the bolt 34 to be inserted therein and includes an intermediate portion 31*a* adapted to pass through the mounting hole 38, an upper portion 31*b* and a lower portion 31*c*, the upper and lower portions 31*b* and 31*c* being positioned at upper and lower ends of the intermediate portion 31*a* and having respective outer diameters larger than that of the intermediate portion 31*a*. The mount member 31 can be forcedly inserted into the mounting hole 38 with an elastic and radially compressive deformation of either one of the upper portion 31*b* and the lower portion 31*c*, thereby being allowed to be mounted to the mount plate 37 in a final configuration as shown in FIG. 4.

Thus configured apparatus allows the device 30 to be mounted on the upper frame 23, for example, in the following manner.

1) Plate holes 33 are formed in a beam member 12 at respective mount-member-provision positions, and plate supporters 36 are welded to the beam member 12.

2) A mount plate 37 is put into each of the plate holes 33 so as to be laid over the plate supporter 36.

3) The beam members 32, 32 are installed on an upper frame 23. This step 3) may be performed prior to the above step 2).

4) At the stage following the completion of the installation of the beam members 32, 32 on the upper frame 23, namely, at the final stage of the assembly, the position of each of the mount plates 37 is adjusted in a horizontal direction including front and rear directions, right and left directions and diagonal directions, and in a vertical direction, within the plate hole 33. This positional adjustment also includes an inclination adjustment of the mount plate 37. Keeping the thus adjusted position and posture, the mount plate 37 is welded to the plate supporters 36, 36 and to the inner surface of the plate hole 33 to be fixed within the plate hole 33. In this stage, the vertical positional change of the mount plate 37 can be compensated by the thickness of the welded material interposed between the mount plate 37 and the plate supporters 36, 36 and thus the support of the mount plate 37 by the plate supporters 36, 36 can be secured.

5) Mount members 31 are mounted to the mount plates 37 respectively, and the device 30 is placed on the mount members 31 and fastened to the beam by bolts 34 and nuts 35. Specifically, the bolt 34 is inserted through the central portion of the mount member 31 and a bolt insertion hole formed in a bottom wall 30*a* of the device 30 from lower side, and the nut 35 is tightly screwed to an upper end of the bolt 34. The device 30 is thus fastened to the beam member 32, involving a vertical compressive deformation of the mount member 31 between the bottom wall 30*a* and the head of the bolt 34.

According to this method, even if thermal deformation such as distortion or warp occurs on the beam member 32 due to the welding of the beam member 32 to the upper frame 23 or the like, the positional adjustment of the mount plates 37 put into the respective plate holes 33 of the beam member 32 after the welding thereof can compensate for the deviation of the mounting position of the mount member due to the distortion or the warp, thereby enabling the position of each of the mount members 31 to be adjusted at a proper position in spite of the thermal deformation, specifically, enabling the longitudinal and lateral pitch, the height position, and the levelness of the mount members 31 to be kept proper. This makes it possible to mount the device 30 on the right side deck 29 accurately against the thermal deformation of the beam members 32, 32.

Furthermore, since the mount plate 37 is put into the plate hole 33 so as to be supported by the plate supporters 36, 36 fixed to the back surface side of the beam member 32 at lower side, the positional adjustment operation and the fixation operation of the mount plate 37 is facilitated and a structural strength for mounting the mount plate 37 is enhanced, as compared with the case of simply welding the mount plate 37 to the peripheral edge of the plate hole 33 with no plate supporter 36.

Moreover, the load acting on the device 30 including the gravitational force is transmitted to the entirety of the beam members 32 via the mount plates 37 and the plate supporters 36, which stabilizes the mounting condition of the device 30. In addition, the plate supporter 36 according to this embodiment, which is fixed to the back surface side of the beam member 32 with no protrusion beyond the surface of the beam member 32, is out of the way of mounting peripheral devices. Besides, the plate supporters 36, 36 traversing the respective lateral ends of the plate hole 33 at the lower side thereof can stably support the mount plate 37 while letting the central portion of the plate hole 33 of the mount plate 37 be downward opened. This allows respective operations of putting the mount member 31 into the plate hole 33, adjusting the position of the mount member 31 within the plate hole 33 and inserting the bolt 34 to be easily performed by utilization of the opened space.

Furthermore, the plate supporter 36 according to this embodiment includes the upper and lateral end surfaces 36*a* and 36*b* which are welded to the horizontal wall 32*a* and the vertical wall 32*b* of the beam member 32 respectively to allow the plate supporter 36 to form a rib of the beam member 32 at the lower side thereof; this enhances the structural strength for mounting the plate supporter 36 and the structural strength for supporting the mount plate 37 to thereby enable the device 30 to be more stably supported.

The invention is not limited to the embodiment as described above, but may include various modifications obvious to persons skilled in the art having common knowledge and skills in the art. For instance, while the device 30 in the embodiment is loaded on the front portion of the right side deck 29 on the upper frame 23, the invention can be also applied to the case of loading the device on a rear portion of the right side deck 29 or a portion other than the right side deck 29.

Besides, the invention is not limited to a hybrid excavator and an entire hydraulic excavator, but may be applied to other various construction machines having a base member configured by use of an excavator.

As has been described, the invention provides a method and apparatus for mounting a device in a construction machine by use of a beam member and a mount member while allowing the position and the levelness of the mount member to be adjusted to thereby enhance the accuracy of mounting the device.

Specifically, the invention provides a method for mounting the device on a frame in a construction machine via a beam member and a plurality of mount members, the method including: forming a plurality of plate holes in the beam member at respective spaced mount-member-provision positions; attaching a plate supporter to a back surface of the beam member at each of the mount-member-provision positions so that the plate supporter borders the plate hole on a lower side of the beam member; installing the beam member on the frame; putting a mount plate into each of the plate holes from above so as to make the support member support the mount plate on a lower side of the mount plate and fixing the mount plate after adjusting a position of the mount plate horizontally and vertically within the plate hole; and mounting each of the mount members to the mount plate fixed in the plate hole corresponding to the mount member and mounting the device on the beam member via the mount members.

Besides, the invention provides an apparatus for mounting a device in a construction machine having a frame, the apparatus including: a beam member which is installed on the frame and provided with a plurality of plate holes at respective mount-member-provision positions; a plurality of plate supporters which are attached to a back surface side of the beam member so as to border the respective plate holes on a lower side of the beam member; a plurality of mount plates which are put into the respective plate holes so as to be supported by the respective plate supporters on a lower side of the mount plate and fixed in the plate hole after a horizontal and vertical adjustment of a position of the mount plate; and a plurality of mount members to be mounted on the respective mount plates. The device is thus allowed to be mounted on the mount plates via the mount members.

According to the above method and apparatus, at each of the mount-member-provision positions in the beam member, the mount plate can be fixed in the plate hole after being put into the plate hole and adjusted in its position horizontally and vertically within the plate hole while supported by the plate supporter from lower side; this allows the mount member to be mounted at a proper position with a high degree of levelness by the positional adjustment of the mount member within the plate hole even under the condition of distortion or warp in the beam member due to the heat of welding for assembling the frame, thereby enhancing the accuracy of mounting the device.

Besides, the support of the mount plate by the plate supporter fixed on the back surface side of the beam member at the lower side of the mount member facilitates respective operations of the positional adjustment and fixation of the mount plate as compared with the case of simply putting into the plate hole and welding the mount plate to a peripheral edge of the plate hole, and further can enhance the structural strength for mounting the mount plate itself. Moreover, the load acting on the device is transmitted to the entirety of the beam member via the mount plates and the plate supporters, which stabilizes the mounting state of the device. In addition, the plate supporters, fixed on the back surface side of the beam member with no protrusion beyond the beam member surface, are out of the way of mounting peripheral devices.

In the device mounting apparatus of the invention, the plate supporter may be preferably provided to each of end portions of the plate hole in a first direction and fixed on the back surface side of the beam member so as to traverse the plate hole in a second direction orthogonal to the first direction at a lower side of the plate hole. Each of the thus fixed plate supporters can stably support the mount plate at the both ends of the plate hole in the first direction orthogonal to the second direction of the traversal while letting a central portion of the plate hole be downward opened. The utilization of thus opened space facilitates respective operations of putting the mount member into the plate hole, adjusting the position of the mount member within the plate hole and inserting a bolt.

Specifically, it is preferable that each of the plate supporters be formed of a plate member vertically provided on the back surface side of the beam member and a part of the mount member be disposed between the plate supporters.

Besides, it is preferable that the beam member preferably has a horizontal wall and a vertical wall continuing to each other, and the plate supporter is welded to the beam member across a back surface of the horizontal wall and a back surface of the vertical wall to be thereby mounted on the back surface side of the beam member so as to form a rib of the beam member. The plate supporter thus mounted across the horizontal wall and the vertical wall of the beam member as a rib can enhance the structural strength for mounting the plate supporter itself and, further, enhance the structural strength for the mount plate, thus more stably supporting the device.

This application is based on Japanese Patent Application No. 2011-164285 filed on Jul. 27, 2011, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A method for mounting a device on a frame in a construction machine, via a beam member and a plurality of mount members, comprising:

forming plate holes in the beam member at respective spaced mount-member-provision positions;

attaching a plate supporter to a back surface of the beam member at each of the mount-member-provision positions so as to make the plate supporter border the plate hole at a lower side of the plate hole;

installing the beam member on the frame;

putting a mount plate into each of the plate holes from above so as to make the plate supporter support the mount plate on a lower side of the mount plate and fixing the mount plate after adjusting a position of the mount plate horizontally and vertically within the plate hole; and mounting each of the mount members to the mount plate fixed in the plate hole corresponding to the mount member and mounting the device on the beam member via the mount members.

2. An apparatus for mounting a device in a construction machine provided with a frame, comprising:

a beam member which is installed on the frame and provided with a plurality of plate holes at respective mount-member-provision positions;

a plurality of plate supporters which are attached to a back surface side of the beam member so as to border the respective plate holes on a lower side of the beam member;

a plurality of mount plates which are put into the respective plate holes so as to be supported by the respective plate supporters on a lower side of the mount plate and fixed in the plate hole after a horizontal and vertical adjustment of a position of the mount plate; and a plurality of mount members to be mounted to the respective mount plates so as to allow the device to be mounted on the mount plates via the mount members.

3. The device mounting apparatus for a construction machine according to claim 2, wherein the plate supporter is provided to each of end portions of the plate hole in a first direction and fixed on the back surface side of the beam member so as to traverse the plate hole in a second direction orthogonal to the first direction at a lower side of the plate hole.

4. The device mounting apparatus for a construction machine according to claim 3, wherein each of the plate supporters is formed of a plate member vertically provided on the back surface side of the beam member, and a part of the mount member is disposed between the plate supporters.

5. The device mounting apparatus for a construction machine according to claim 2, wherein the beam member has a horizontal wall and a vertical wall continuing to each other, and the plate supporter is welded to the beam member across a back surface of the horizontal wall and a back surface of the vertical wall to be thereby mounted on the back surface side of the beam member so as to form a rib of the beam member.

* * * * *